United States Patent [19]

Beckershoff

[11] 4,050,850

[45] Sept. 27, 1977

[54] ARRANGEMENT FOR LOCKING PARTS INTO THE ROTOR OF A TURBOMACHINE

[75] Inventor: Wolfgang Beckershoff, Fislisbach, Switzerland

[73] Assignee: BBC Brown Boveri & Company Limited, Baden, Switzerland

[21] Appl. No.: 650,061

[22] Filed: Jan. 19, 1976

[30] Foreign Application Priority Data

Jan. 30, 1975 Switzerland ..... 1105/75

[51] Int. Cl.[2] ..... F01D 5/32

[52] U.S. Cl. ..... 416/221; 416/218

[58] Field of Search ..... 416/215–218, 416/219–221

[56] References Cited

U.S. PATENT DOCUMENTS

| | | | |
|---|---|---|---|
| 2,843,356 | 7/1958 | Hull | 416/220 X |
| 2,867,408 | 1/1959 | Kolb et al. | 416/220 |
| 2,949,278 | 8/1960 | McCormick | 416/220 |
| 2,994,507 | 8/1961 | Keller et al. | 416/221 |
| 3,001,760 | 9/1961 | Guernsey et al. | 416/221 |
| 3,053,504 | 9/1962 | Shelley | 416/215 |
| 3,202,398 | 8/1965 | Webb | 416/220 |
| 3,393,862 | 7/1968 | Harrison | 416/220 |
| 3,904,317 | 9/1975 | Cardin et al. | 416/220 |
| 3,930,751 | 1/1976 | Straslicka | 416/193 A |

FOREIGN PATENT DOCUMENTS

| | | | |
|---|---|---|---|
| 266,970 | 5/1950 | Switzerland | 416/218 |

*Primary Examiner*—Everette A. Powell, Jr.

*Attorney, Agent, or Firm*—Toren, McGeady and Stanger

[57] ABSTRACT

Rotor parts, such as blades, are locked in axially extending slots in a rotor by locking members positioned in circumferentially extending slots extending between and intersecting the axially extending slots. The locking members are slidably positionable into the circumferentially extending slots and displaceable between a release position and a locking position where they hold the rotor parts within the axially extending slots. A retaining element is in operative association with the locking member for securing it in the locking position. The locking members have ridges which seat against corresponding ridges formed in the circumferentially extending slots for retaining the locking members within the slots. In the locking position, the locking elements form a closure for the opening through the rotor surface into the circumferentially extending slots so that a completely smooth surface is presented on the surface of the rotor.

22 Claims, 15 Drawing Figures

ARRANGEMENT FOR LOCKING PARTS INTO THE ROTOR OF A TURBOMACHINE

SUMMARY OF THE INVENTION

This invention concerns an arrangement of locking elements for securing parts mounted on the rotor of a turbomachine. The locking elements can be one or more parts inserted in circumferential slots extending around the rotor between the bases or feet of adjacent parts to be secured, with the parts to be secured being held in fixing slots which extend axially or axially obliquely of the rotor.

Various fastenings have been used to lock parts, for instance, turbine blades, mounted on the rotors of turbomachines. The fastening elements are placed, for example, in a circumferential slot located approximately in the middle of the parts to be secured such that these parts are arranged at the ends of the serrations situated between the axial slots of the rotor disc and the fastening elements at the base of the parts to be secured enclose the parts in the axial direction.

Fastening elements are also placed in circumferential slots located at the outer ends of the serrations in the rotor, although these fastening elements extend over only a part of the axial width of the blades.

The fastenings can also be so arranged that they are placed at the base of the axial fixing slot and by means of hooks bent from wire or sheet which engage in the end faces of the base of the part to be secured, hold this part in the axial slot and prevent it from moving.

Owing to the use of heat-resistant materials such as employed in gas turbines, fastenings of this kind become partly ineffective or are technically unsatisfactory. It is common to all the locking or fastening systems mentioned that the last blade can be fixed into the rotor only with the aid of a special fastening element which in turn also has to be secure, and that each individual fastening element has to be separately caulked or bent during assembly. With the stated methods of locking, the blade or spacer is fixed only at the outer, or caulking, side of the shoulder or the base or foot, and therefore nonuniform stresses can occur so that the fastening elements fitted between two blades break, or can no longer fully perform their locking function.

Furthermore, all the fastenings mentioned cannot be used in every instance without additional expense, especially in those cases where the spaces between unshrouded blades are occupied by the rotor or disc material, as is customary with compressor rotor blades in axial or axially oblique slots. In such cases, fastenings whereby the locking pieces are arranged under the blade feet and fitted in the circumferential slots in the rotor would create discontinuities in the hub surface at the circumferential slots, and this would be aerodynamically unfavourable. Since machining the rotor by turning it on a lathe to make the circumferential slots can be done not only cheaply but also extremely accurately, this technique has been preferred for mounting the blades and fastenings. However, with the fastening elements used until now there still remains the said roots, that when assembly is complete the fastenings can no longer be seen from the outside, and therefore can no longer be checked, and thus it can not be determined if a fastening has been omitted, for example.

The object of the invention is to avoid the shortcomings discussed above, and to provide an arrangement of locking elements for securing parts mounted on the rotor of a turbomachine, in particular turbine blades so that the presence of the locking elements, and also their position, can be easily checked, and at the same time disturbing joints in the hub of the rotor are sealed.

This object is achieved in one embodiment by forming the locking elements of a securing piece and a spreader or locking assembly including a retaining device, corresponding steps are formed in contacting surfaces of the spreader assembly and securing piece, and the surfaces of the securing piece and spreader or locking assembly facing the parts to be locked are provided with projections which engage in matching recesses in the parts to be locked to the rotor.

It is particularly advantageous if the circumferential slot on the rotor is in the form of a hammerhead slot and located in the middle of the axial extent of the parts to be secured and providing inwardly directed ridges, and the locking elements have supporting ridges identical to the ridges formed by the profile of the hammerhead slot extending in the axial direction, with the length of the ridges on the locking elements along the circumferential slot being such that they correspond to the tangential dimension of the width of the axial or axially oblique slots.

The advantage of this arrangement is to be seen particularly in that a two-part fastening is located in hammerhead shaped slots arranged centrally relative to the axial extent of the blade foot and having a recessed base, such shaped slots provide inwardly directed ridges and the locking elements are held by corresponding ridges against the centrifugal force acting on them, the tangential length of the ridges in the circumferential direction and their configuration, both on the securing piece and the spreader or locking assembly, being such that the locking elements can be inserted radially at the point of intersection between the axial or axially oblique root-fixing slots and the circumferential slots. When the locking elements have been lowered radially to a position at which their ridges in the radial direction are under the ridges of the hammerhead slots, the individual locking elements can be moved under the latter and slid to their final position. The fixing groove in the blade root is at the side of the root, preferably in the region of the concave side of the blade so that the groove is outside the centrifugal force field of the blade. Because the securing piece is provided with three steps, for example, on the side facing the spreader assembly, whereas the spreader assembly has only two corresponding steps, and hence in the radial direction is smaller than the securing piece by the height of one step, when the spreader assembly has been lowered to the bottom of the circumferential slot the securing piece can be moved in the circumferential direction by the corresponding dimension of one such step, whereupon the projection disengages from the fixing groove in the blade, and thus releases it. With the securing piece in the locked position, the spreader assembly can be raised radially outwardly from the bottom of the circumferential slot. In its radially outer position the two steps of the spreader assembly then engage the two radially outer steps of the securing piece and the circumferential slot is filled flush with the outer surface of the rotor hub by the radially outer surface of the spreader assembly and securing piece and accordingly rendering circumferential movement of the securing piece impossible.

In an alternative form the spreader assemblies and securing pieces are arranged in the locked position so that they completely cover the circumferential slot between each two blades.

If the blade root is sufficiently wide, it can be provided on both sides with a fixing groove, in which case the spreader assembly is also provided with a locking projection which can engage in the recess provided by the fixing groove. In the secured position, the spreader assembly, or that part of the locking system performing this function, can be brought into the locking position by means of the retaining device, i.e. the retaining device presses the spreader assembly outwards until its supporting ridges fit flush against the inwardly projecting supporting ridges formed by the hammerhead slots. The circumferential hammerhead slots are thus completely filled at the radially outer surface of the rotor hub, the locking position being aided by the centrifugal force occurring in operation.

In preferred alternative forms of the invention the retaining device can be threaded or in the form of a spring biased member.

It is also expedient in place of the spreader assembly-securing piece to fit a one-piece locking element between each two adjacent blades, in which case the one-piece locking element can be of symmetrical or asymmetrical shape.

The various features of novelty which characterize the invention are pointed out with particularity in the claims annexed to and forming a aprt of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
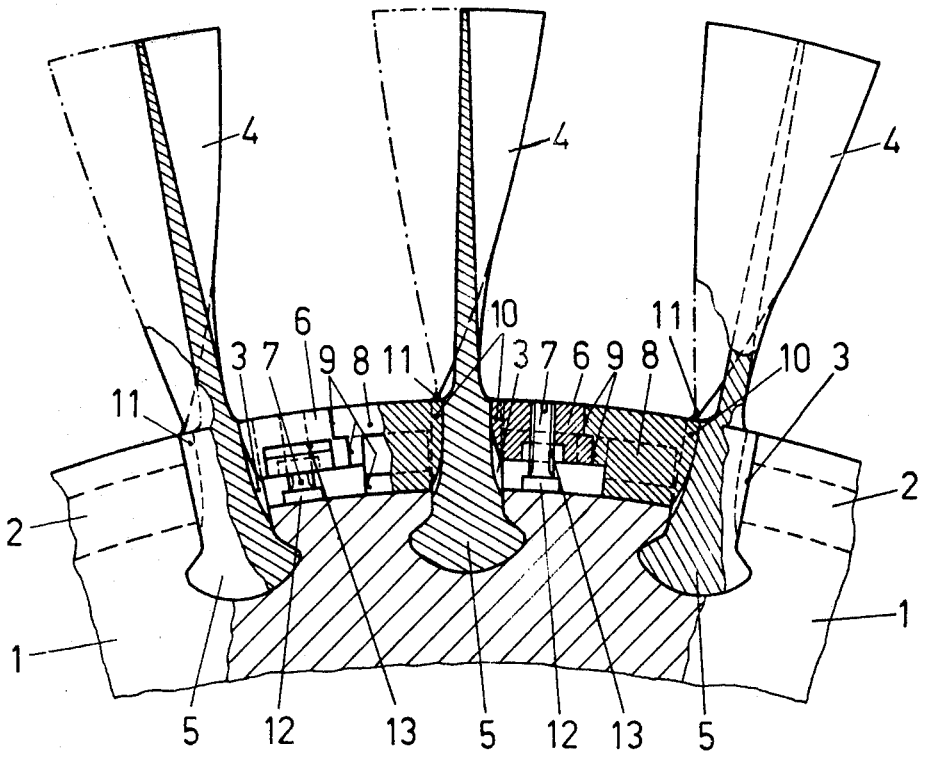
FIG. 1 shows a portion of a rotor, partly in section, with blading and locking elements, in the locked position.

FIG. 1 shows a rotor 1 of a turbomachine in which circumferential slots 2 and axial slots 3, which can also be in the form of axially oblique slots are arranged. Blades 4 have their blade roots 5 inserted in the axial slots. Locking elements each comprising a locking or spreader assembly 6 referred to hereinafter simply as a "spreader assembly" with a retaining device 7 and a securing piece 8 are inserted in the circumferential slots 2 between the roots 5 of adjacent blades 4. The spreader assemblies 6 and the securing pieces 8 each have corresponding steps 9, however, while the securing piece has three steps the spreader assembly has only two steps. The end surfaces of the securing pieces 8 facing the parts to be locked, i.e. blades 4, are provided with projections 10 which fit into corresponding recesses 11 in the blades 4. The retaining device 7 consists of a threaded component 12 which fits into a tapped opening 13 in the spreader assembly 6. When the side of the spreader assembly 6 is in contact against the blade root 5, by turning the threaded component 12 with a suitable tool, for example a screwdriver, the spreader assembly 6 is lifted radially outwardly relative to the axis of the rotor until its steps 9 coincide with the outer corresponding steps 9 of the securing piece 8. When the spreader assembly 6 is fully displaced outwardly, the circumferential slot 2 in the surface of the rotor between the blades 4 is completely filled, giving a completely smooth or uninterrupted rotor hub surface. At the same time, the locking elements are secured against circumferential movement.

Figure 1A:
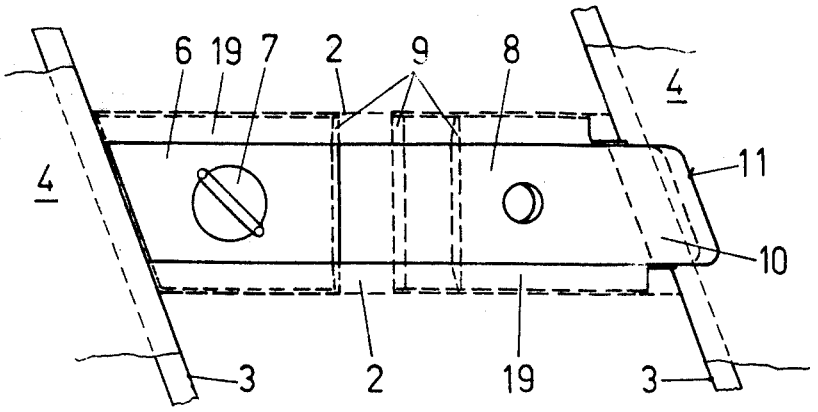
FIG. 1*a* is a plan view of one of the locking elements shown in FIG. 1.

The locking elements can be clearly seen on a larger scale in the plan view of FIG. 1*a*. The blades 4 are slid into the axial slot 3 and the locking device is inserted in the circumferential slot 2 between two adjacent blades 4 so that the spreader assembly 6 fits flush against the left-hand blade 4, while the securing piece 8 engages by means of its projection 10 in the recess 11 in the right-hand blade 4. The retaining device 7 is already in the locked position, i.e. the steps 9 of the spreader assembly 6 are clamped against the two radially outer steps 9 of the securing piece 8.

Figure 2:
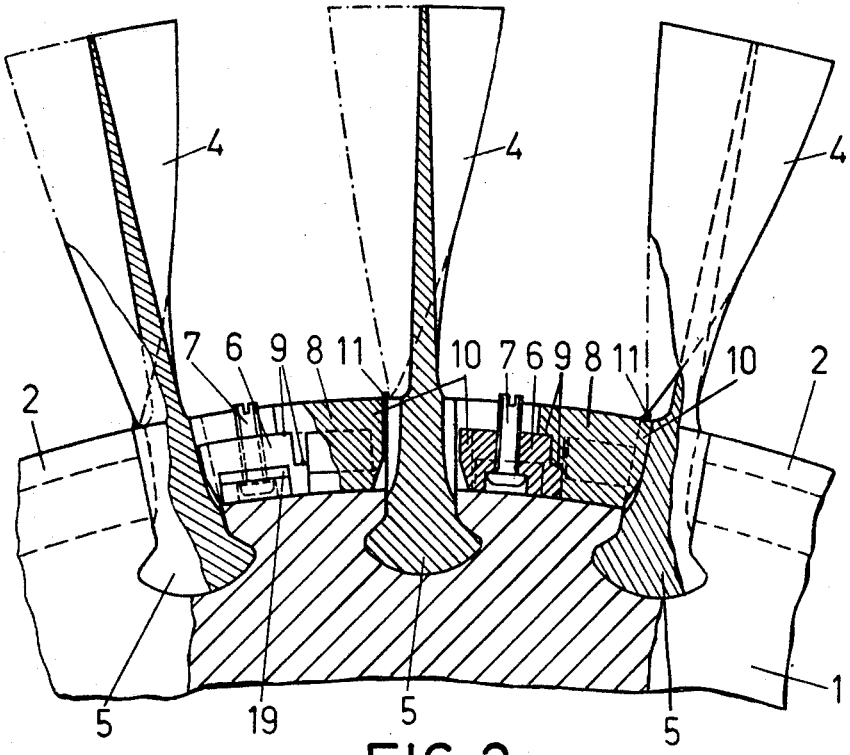
FIG. 2 is a view similar to FIG. 1 with the locking elements in the unlocked position.

In FIG. 2 the locking elements are shown in such a way that one blade 4 is unlocked on both sides, i.e. one securing piece 8, the right-hand one, is laid in the circumferential slot 2 so that its projection 10 fits into the recess 11 is the adjacent blade, while the associated spreader assembly 6 is still on the bottom of the slot and its steps 9 are pushed up against the lower two steps 9 of the securing piece 8 so that the projection 10 of the spreader assembly 6 is retracted from the corresponding recess 11 in the adjacent blade.

On the other side of the blade 4 the spreader assembly 6, the one on the left-hand side, is also resting on the bottom of the circumferential slot 2. In this position, the steps 9 allow the securing piece 8 on this side to be moved circumferentially towards the spreader assembly 6, and thus the projection 10 in the securing piece is spaced from the recess 11 in the blade 4.

Figure 2A:
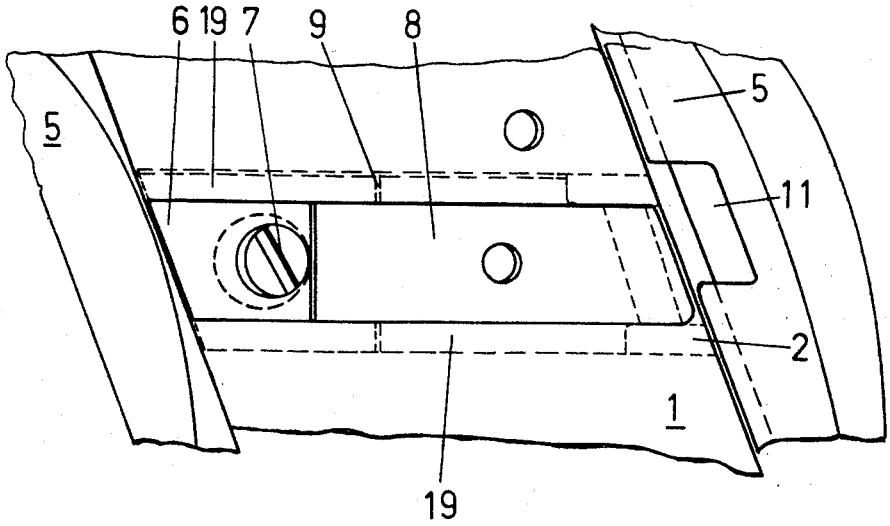
FIG. 2*a* is a plan view of one of the locking elements shown in FIG. 2.

FIG. 2*a* shows, on a larger scale, a plan view of the left-hand spreader assembly 6, the securing piece 8, the retaining device 7 and two blade roots 5, the locking element being shown in the unsecured condition, while the blade 4 is already moved slightly in the axial direction of the rotor.

Figure 3:
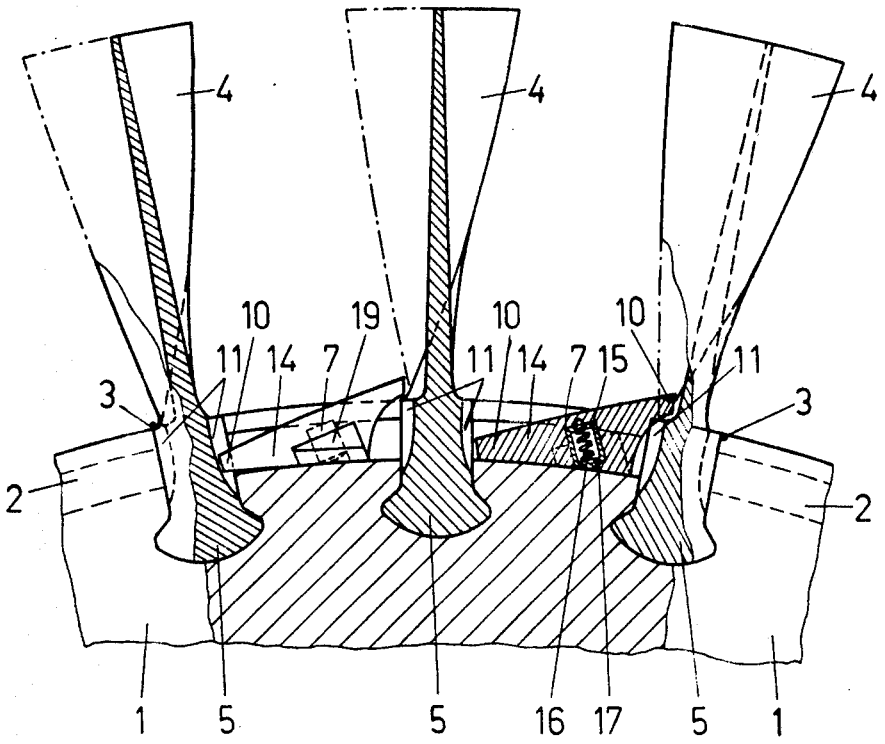
FIG. 3 shows a portion of a rotor, partly in section with blading and one-piece asymmetrical locking elements.
Figure 3A:
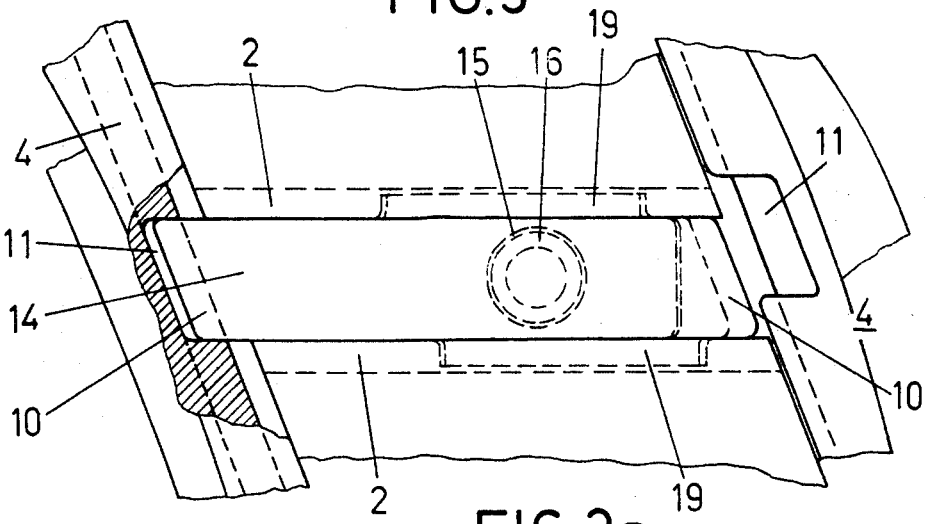
FIG. 3*a* is a plan view of one of the locking elements shown in FIG. 3.
Figure 4:
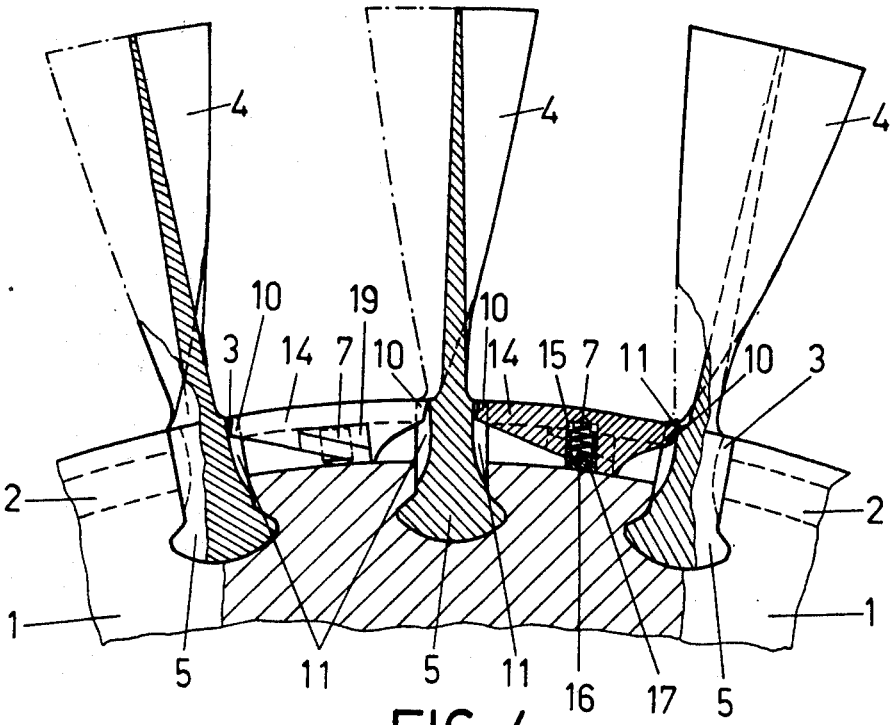
FIG. 4 is a view similar to FIG. 3 with the locking elements assembled and secured in position.
Figure 4A:
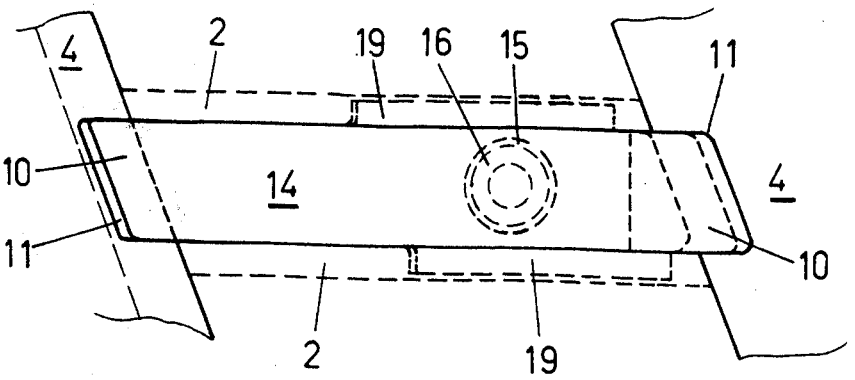
FIG. 4*a* is a plan view of one of the locking elements as shown in FIG. 4.

FIGS. 3, 3*a* and 4 again show the rotor 1 whose axial slots 3, which can also take the form of axially oblique slots, accommodate the parts to be locked, blades 4 for example, and whose circumferential slots 2, which can be in the form of hammerhead slots, asymmetrical locking elements 14 are inserted to lock the blades 4. The asymmetrical locking elements 14 are similarly provided with a retaining device 7, which comprises a drilled hole 15 in the locking element 14, a compression spring 16 and a pressure piece 17. At either end of each asymmetrical locking element 14 are projections 10 which in the locked position (FIG. 4, 4a) engage in the recesses 11 in the adjacent blades 4. Again a completely smooth surface is created between the individual blades, as the circumferential slot 2 is completely filled by the locking element 14 in the locking position (FIG. 4).

To release a blade 4 the two locking elements 14 on either side of the blade 4 are tipped (as shown in FIG. 3) and moved away from the blade 4 in the circumferential direction.

Figure 5:
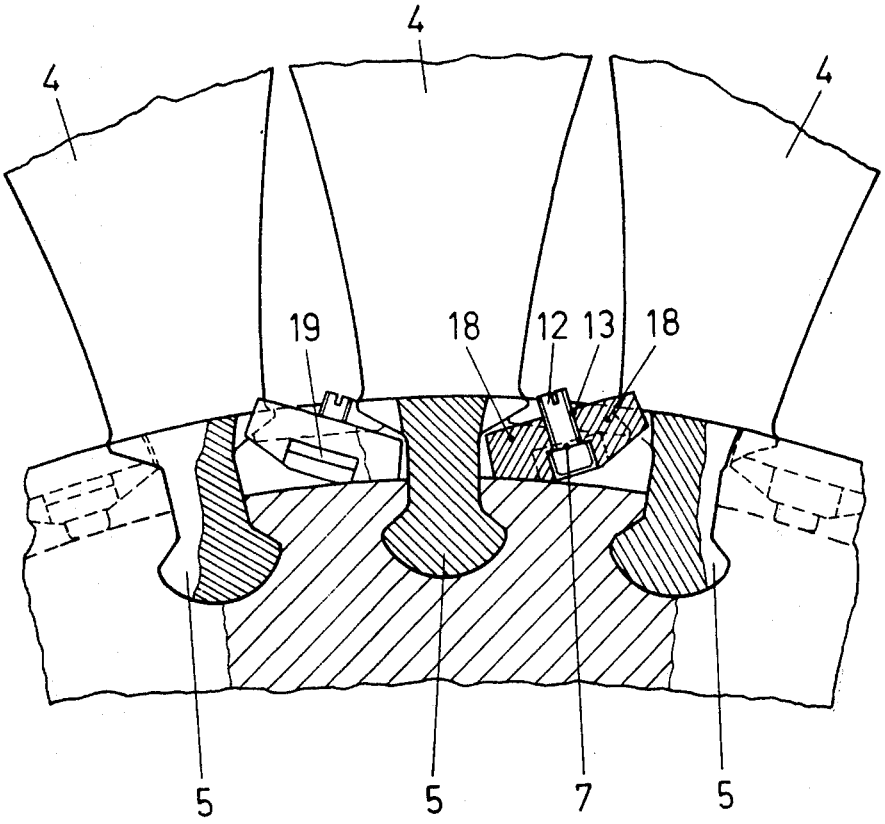
FIG. 5 shows a portion of a rotor, partly in section, with blading and symmetrical locking elements.
Figure 6:
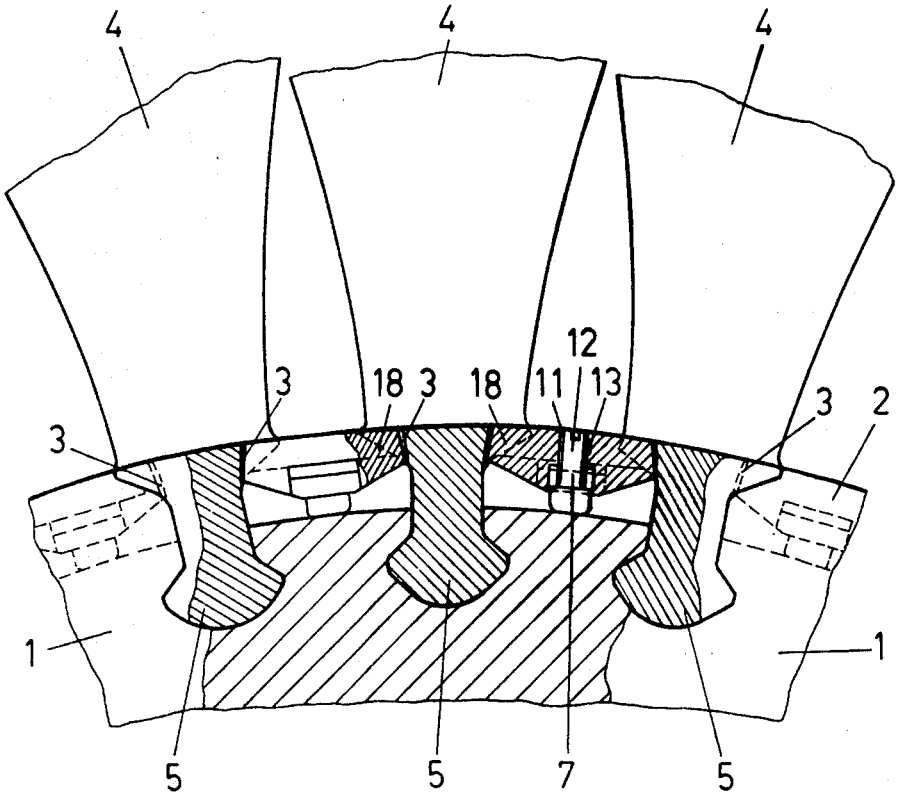
FIG. 6 shows part of a rotor as in FIG, 5 with the locking elements assembled in the securing position.
Figure 7:
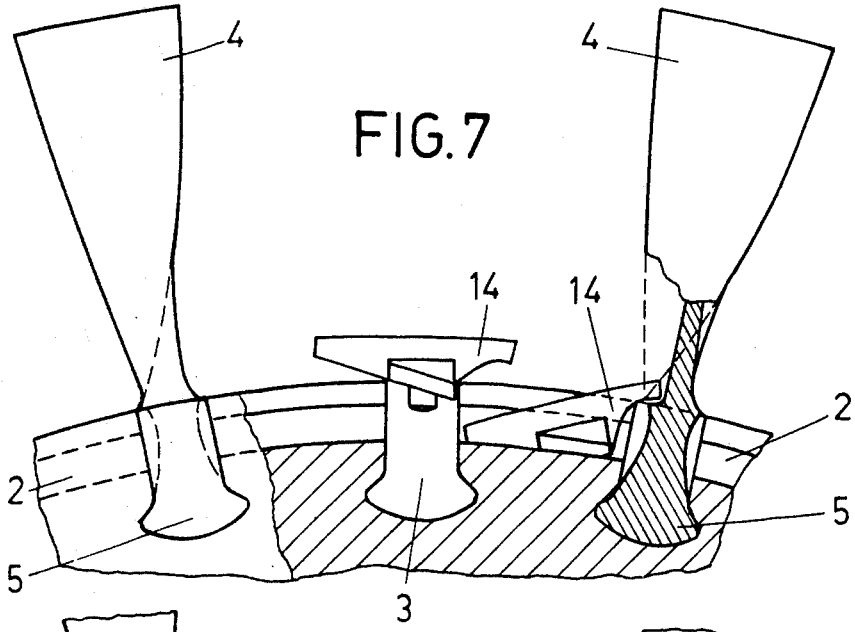
FIGS. 7, 7*a* and 7*b* show separate portions of the locking elements in their assembly into the rotor.
Figure 7A:
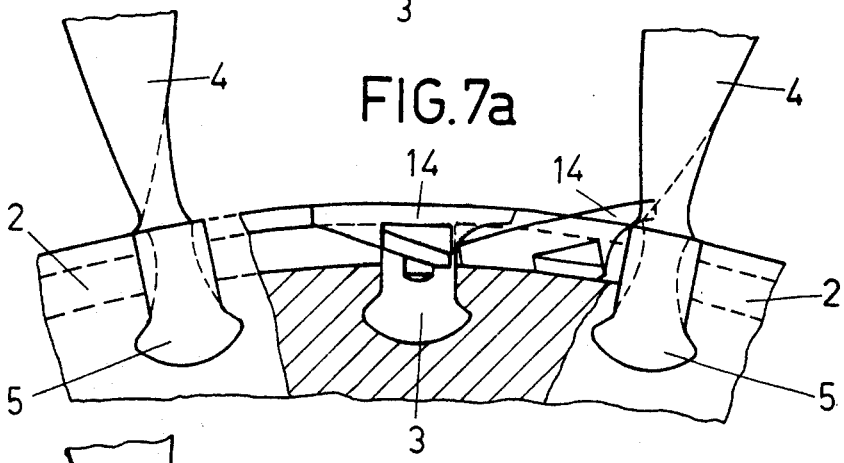
Figure 7B:
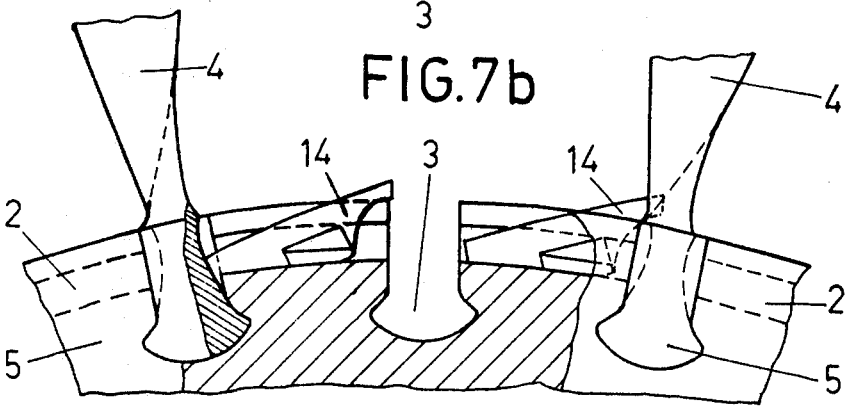

In FIGS. 5 and 6 the blades 4 are locked by means of symmetrical locking elements 18 provided with the same retaining devices 7 as in the embodiment shown in FIG. 1 and 2, the symmetrical locking element 18 incorporating the threaded component 12 and the tapped hole 13. As can be seen from FIG. 5, the symmetrical locking elements 18 are inserted in the circumferential slots 2 of the rotor 1 in the same manner as shown in FIGS. 7, 7a and 7b, and tipped on either side of an axial slot 3 which contains no blade 4. With the locking elements 18 inserted in this position the blade root 5 of the blade 4 to be locked is slid into the free axial slot 3. To secure the blade the two locking elements 18 are tipped so that their hub portions are parallel to the hub surface of the rotor 1, whereupon their circumferentially spaced ends engage in the recesses 11 in the blade root. By screwing the threaded components 12 into the locking elements 18 they act as thrust screws and raise the locking elements 18 radially outwards until the ridges 19 on the locking elements fit flush against the inwardly extending ridges 19 at the rotor surface of the circumferential slots 2. At the same time, the ends of the locking elements 18 serving as projections 10, engage in the corresponding recesses 11 in the adjacent blade roots 5 and the opening into the circumferential slots 2 at the rotor hub surface one either side of the fitted blade 4 is smooth, flush and completely filled.

FIGS. 6a and 6b again show a symmetrical locking element 18 similar to that in the preceding FIGS. 5 and 6, except that here a spring biased retaining device 19 is provided, comprising a drilled hole 15, a compression spring 16 and a pressure piece 17. The locking element 18 is fitted in the circumferential slot 2 in the same way as for the version described with reference to FIGS. 5 and 6.

FIGS. 7, 7a and 7b illustrate the separate steps in assembling a locking device. Here, the last blade 4 with its blade root 5 still has to be fitted in the as yet bladeless axial slot 3 in the rotor 1 that is the middle slot. The locking elements, for example asymmetrical locking elements 14, are inserted at the point of intersection between axial slot 3 and circumferential slot 2, and are slid along the circumferential slot 2 away from the axial slot 3 until they come in contact with the roots 5 of the blades 4 already fitted into the rotor. They then lie on the longer of their two shorter sides and so expose the middle axial slot 3 to allow the last blade 4 to be inserted. When the blade 4 has been inserted, both locking elements 14 are forced up into their operating position until they fill the circumferential slot 2 and form a smooth surface in the rotor surface between the adjacent blades 4.

The reference numbers in FIG. 1 apply also to identical parts in the other figures.

The procedure for fitting or removing the locking elements and blades comprises the following steps:

In the versions shown in FIGS. 1, 1a, 2 and 2a, the locking elements, comprising the spreader assemblies 6, retaining device 7 and a securing piece 8, are held in circumferential slots 2 which are in the shape of hammerhead slots, against the centrifugal force due to rotation of the rotor 1. The length and arrangement of the circumferentially extending ridges on each spreader assembly 6 and securing piece 8 are such as to allow the individual parts (6,8) to be introduced at the point of intersection between the circumferential slot 2 and the axial or axially oblique slots 3. Having lowered the spreader assemblies 6 and the securing pieces 8 radially at the intersection between the circumferential slot 2 and axial slots 3 until the ridges 19 of the spreader assemblies 6 and securing pieces 8 lie in the radial direction under or inwardly of the ridges of the hammerhead-shaped circumferential slots 2, the spreader assemblies 6 and the securing pieces 8 can be slid in the circumferential direction under the latter ridges into their final position. Recesses 11 are provided in each side of the blade root 5, preferably in the region of the concave side of the blade, whereupon the recess 11 lies outside the centrifugal force field of the blade. Both the spreader assembly 6 and the securing piece 8 are provided on their mutually contacting end surfaces with corresponding steps 9 of such a size that they can fit alternately into each other. The spreader assembly 6 has two steps 9, whereas the securing piece 8 has three steps. If the two steps 9 of the spreader assembly 6 are made to engage the middle and radially outer steps 9 of the securing piece 8, the sum of the circumferential lengths of these locking elements is greater by the circumferential length of one step than when the steps of the spreader assembly 6 are engaged in the middle and radially inner steps 9 of the securing piece 8. In the latter case the blade 4 to be secured can be moved unhindered in its axial slot 3, i.e. it can be inserted or removed.

The end of the securing piece 8 facing the blade to be secured incorporates a projection 10 which in the locked position fits into the recess 11 in the blade root 5. In this position the spreader assembly 6, or a securing part performing the same function, can be pressed radially outwards into the locking position by means of at least one retaining device 7 until the locking elements fit flush against the shoulders of the circumferential slots 2. When the spreader assembly has been moved radially outward, the opening of the circumferential slots 2 in the rotor surface between the individual blades 4 are completely filled, this position being aided in operation by the centrifugal force generated. For dismantling, the spreader assembly 6, the radial thickness of which is smaller that that of the securing piece 8, can be lowered radially inwards by this difference in thickness from its operating or locking position until it lies on the bottom of the circumferential slot 2, whereupon it no longer prevents the securing piece 8 itself from moving tangentially. The lowest corresponding step 9 of the securing piece 8 is set back by an amount which allows the securing piece 8 to move sufficiently far over the lowered spreader assembly 6 in the circumferential direction that the projection 10 of the securing piece 8 disengages fully from the corresponding recess 11 in the blade root 5, and thus the released blade 4 can be slid out of its axial slot 3. If the blade root 5 is made wide enough, it can be provided on both sides with a recess 11, in which case the spreader assembly 6 also incorporates a projection 10 which can fit into a corresponding recess 11.

In the version shown in FIGS. 3, 3*a*, 4 and 4*a* the locking elements are made in one piece. It is possible for such locking elements to be either symmetrical 18 (as shown in FIGS. 5, 6, 6*a* and 6*b*) or asymmetrical 14. In both forms the locking element 14 or 18 is held in the circumferential slots 2 by means of supporting ridges which engage ridges at the slot opening in the rotor surface to counter the centrifugal force. Both the asymmetrical and the symmetrical locking elements, 14 and 18 respectively, are each as long as the circumferential distance between the lateral surfaces of the blade roots 5 of two neighbouring blades 4, plus the circumferential length of the locking projection(s). In the locked position the locking element completely fills the recess 11 of the blade 4, and also the opening of circumferential slot 2 in the hub surface of the rotor 1. The radial thickness of the asymmetrical locking element 14 extends to the bottom of the circumferential slot 2 only in the vicinity of the retaining device 7. From this point the underside of the asymmetrical locking element 14 is angled so that its radial thickness decreases to a few millimeters, approximately the thickness of a bottom shroud. The asymmetrical locking element 14 is held in the locked position by means of the retaining device 7, this position being aided by the centrifugal force occurring when the rotor is in operation. The resultant of all centrifugal forces of the asymmetrical locking element 14, and also the forces of the retaining device 7 preferably pass through the centre of the line joining the centroids of the supporting surfaces of its ridges.

If the locking element 14 includes a tapped hole 13 (such as shown in FIG. 5) for the threaded component 12, the threaded component 12 is unscrewed radially outwards until its head occupies the countersunk hole provided for this purpose on the underside of the locking element 11. The head of the threaded component 12 then serves as a safeguard against loss during operation, which would cause the blades 4 to be damaged. The thinner part of the asymmetrical locking element 14 can then be pressed inwards into the circumferential slot 2, whereupon the locking element 14 tips about the edge between the projection 10 and the bevelled underside. This ensures that the ridges of the locking element 14 are so arranged that this tipping movement is not hindered by jamming, but that the ridges separate at all points from the opposing ridges of the circumferential slots 2, or at least do not press against the opposing ridges. If the blade incorporates a web under its bottom shroud as a result of sufficiently deep lateral recesses, after the thinner part of the asymmetrical locking element 14 has been radially lowered in the region of this web (not shown), the locking element 14 can be slid circumferentially into this recess so that its projection 10 at the other end disengages from the corresponding recess 11 in the blade 4. This blade 4 is then no longer secured against axial or axially oblique movement. In the case of lightly stressed rotors having sufficiently small tangential stresses in the region of the hub, or in cases where the axial slots for the blade roots are much deeper than the circumferential slots for the locking elements, the retaining device 7 can be located at a suitable position in a countersunk hole in the bottom of the circumferential slot 2. This has the advantage that this retaining device 7 no longer has to be secured against turning during operation, as rotation against the direction of the centrifugal force is not to be expected. If the blade has no web, as shown in FIG. 3 and FIG. 4, the required recess below the hub part can be located in the blade root 5, thus allowing the locking element 14 to be moved circumferentially. If the bottom blade shrouds are sufficiently broad, this end of the locking element 14 can also be used for securing purposes by providing it with an additional projection, the thickness of which, however, must be such as to allow easy assembly and dismantling, or it must be possible to insert the locking element 14 under a tangential recess beneath the blade root 5.

Figure 6A:
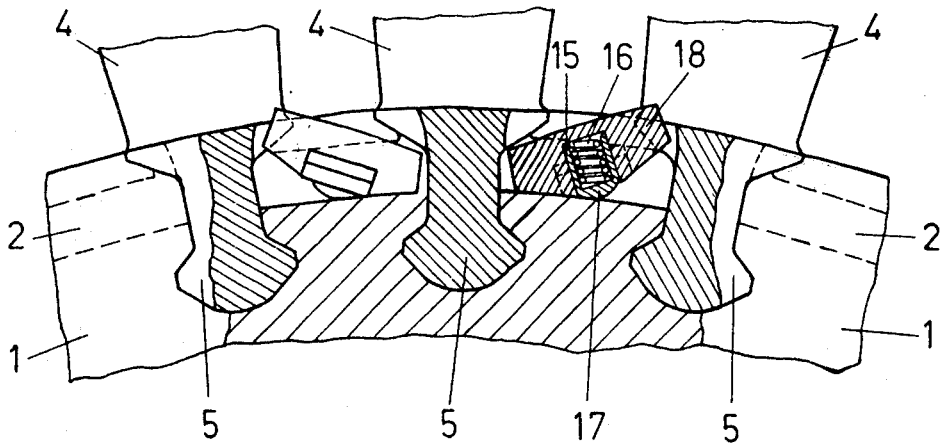
FIGS. 6*a* and 6*b* show different positions of the assembly of the symmetrical locking elements of FIG. 6 with spring biased retaining devices.
Figure 6B:
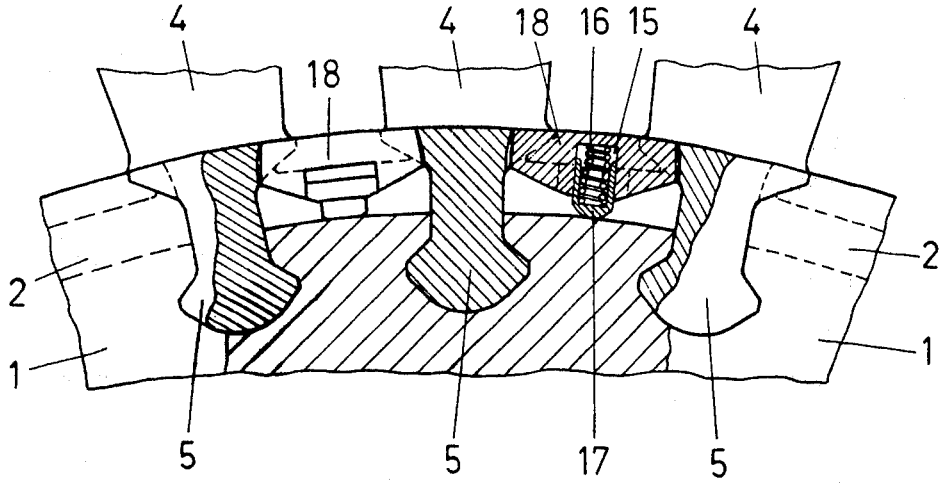

FIGS. 6, 6*a* and 6*b* show individual stages in the fitting of a locking element 18 which is symmetrical on both sides and can either be tipped or moved parallel radially inwards. Here again, the retaining device 7 can be in the form of a tapped hole 13 with threaded component 12, or a drilled hole 15 with compression spring 16 and pressure piece 17. The symmetrical locking elements 18 are fitted in a manner similar to that used for the asymmetrical locking elements 14 described above.

With the arrangement of locking elements of the invention it is possible, both when installing and removing a rotor provided with blading, to take out any blade individually, without having to start at a special fastening element and remove other blades and locking elements. In addition, the ease of fitting and removing individual blades allows blades to be exchanged for rebalancing purposes in the event of different moments of inertia, without having to remove a whole row of blades from the rotor.

The locking elements of the invention, as described above, the suitable not only for drum-type rotors of turbines, but equally well for disc-type rotors in compressors and other fluid flow machines, it being not only possible to remove and fit any blade individually, but also the arrangements of the invention are particularly suitable as final fastening elements which can be used repeatedly, in which case special openings for final fastening elements, and also any welding work on the rotor or on these fastening elements, are unnecessary.

While specific embodiments of the invention have been shown and described in detail to illustrate the application of the inventive principles, it will be understood that the invention may be embodied otherwise without departing from such principles.

What is claimed is:

1. An arrangement for locking parts in the rotor of a turbomachine comprising a rotor having first slots extending circumferentially around said rotor and second slots extending transversely across said first slots and spaced apart in the circumferential direction around said rotor so that said second slots extend generally in the axial direction of said rotor, rotor parts having roots thereon with each said rotor part having its roots fitted into one of said second slots so that the roots of said rotor part are spaced apart in the circumferential direction by the said first slots, and locking means positioned within said first slots and displaceable only in a plane transverse to said second slots and passing through said first slots for movement therein between a release position and a locking position, said locking means having outer end faces disposed in locking engagement with the surface of the roots of said rotor parts when in the locking position, said outer end faces of said locking means being displaced from locking engagement with said rotor parts when in the release position, and said locking means being incompressible along the direction of said first slots when in the locking position.

2. An arrangement, as set forth in claim 1, wherein said first slots have a hammerhead shape in transverse section with inwardly directing ridges extending along the circumferentially extending edges of said first slots at the outer surface of said rotor.

3. An arrangement, as set forth in claim 2, wherein said locking means has laterally outwardly extending supporting ridges along the radially outer side surfaces thereof when positioned within said first slots with the supporting ridges arranged to fit against and radially inwardly of the ridges of said first slots.

4. An arrangment, as set forth in claim 3, wherein the lengths of said supporting ridges correspond to the tangential dimension of said second slots measured in the circumferential direction of said rotor.

5. An arrangement, as set forth in claim 1, wherein said locking means positioned in said first slot forms a complete closure of the opening into said first slot formed in the circumferentially extending surface of the rotor when said locking means is in the locking position.

6. An arrangement, as set forth in claim 1, wherein the roots of said rotor parts have recesses arranged to face into said first slots, and wherein said outer end faces of said locking means is provided with projections arranged to be displaceably fitted into the recesses in saidroots.

7. An arrangement, as set forth in claim 1, wherein said locking means comprises a locking assembly and a securing piece positioned within each said first slot located between two adjacent said second slots, a retaining device displaceably carried by said locking assembly for retaining said locking means in said locking position, said locking assembly and said securing piece being aligned with each other in each said first slot so that at one end of the first slot an end face of said locking assembly can be positioned in contact with the root of the rotor part in the adjacent said second slot, and at the other end of the first slots an end face of said securing piece can be positioned in contact with the root of the rotor part in the other adjacent said second slot.

8. An arrangement, as set forth in claim 7, wherein said locking assembly and said securing piece each have first end surfaces and second end surfaces extending transversely of the circumferential direction of the rotor, said first end surfaces facing one another and said second end surfaces forming said outer end faces of said locking means facing the roots of said rotor parts in said second slots located at the opposite ends of said first slot, said first end surfaces having corresponding steps arranged to fit together in the locking position.

9. An arrangement, as set forth in claim 7, wherein said retaining device comprises a threaded member in threaded engagement with said locking assembly and extending in the radial direction of said rotor, and said locking assembly being displaceable between the locking position and the release position by threadingly displacing said threaded member relative to said locking assembly.

10. An arrangement, as set forth in claim 7, wherein said retaining device includes a spring-biased retaining member for holding said locking assembly in the locking position.

11. An arrangement, as set forth in claim 1, wherein said locking means comprises a unitary locking element slidably movable into each said first slot and said unitary locking element includes a retaining device for holding said locking element in the locking position.

12. An arrangement, as set forth in claim 11, wherein said locking element is symmetrical about its midpoint in the circumferential direction of said first slot.

13. An arrangement, as set forth in claim 11, wherein said locking element is asymmetrical about its midpoint in the circumferential direction of said first slot.

14. An arrangement, as set forth in claim 11, wherein said roots of said rotor parts facing into said first slot have recesses therein, and the opposite ends of said locking elements spaced apart in the circumferential direction are shaped to fit into and lock said rotor parts in the adjacent said second slots.

15. An arrangement, as set forth in claim 11, wherein said retaining device comprises a threaded member in threaded engagement with said locking element and said locking element being displaceable in the locking position by threadedly displacing said threaded member relative to said locking element.

16. An arrangement, as set forth in claim 11, wherein said retaining device includes a spring-biased retaining member for holding said locking memeber in the locking position.

17. An arrangement, as set forth in claim 11, wherein said first slots have a hammerhead shape in transverse section with inwardly directed ridges extending along the circumferential edges of said first slot at the circumferentially extending surface of said rotor, said locking member has laterally outwardly extending supporting ridges along the radially upper side surfaces thereof when positioned within said first slots with the supporting ridges arranged to fit against the ridges of said first slots.

18. An arrangement, as set forth in claim 11, wherein said locking element has a radially upper surface when positioned within said first slot which is arranged to form a closure for said first slot in the circumferentially extending surface of said rotor when said locking element is positioned in the locking position.

19. An arrangement for locking parts in the rotor of a turbomachine comprising a rotor having first slots extending circumferentially around said rotor and second slots extending transversely across said first slots and spaced apart in the circumferential direction around said rotor so that said second slots extend generally in the axial direction of said rotor, rotor parts having roots thereon with each said rotor part having its roots fitted into one of said second slots so that the roots of said rotor part are spaced apart in the circumferential direction by the said first slots, locking means positioned within said first slots and displaceable only in a plane transverse to said second slots and passing through said first slots for movement therein between a release position and a locking position with said locking means in the locking position being disposed in locking engagement with the surface of the roots of said rotor parts, and being incompressible in the direction of said first slots when in the locking position, and in the release position said locking means being displaced from locking engagement, said locking means comprising a locking assembly and a securing piece positioned within each said first slot and located therein between two adjacent said second slots, a retaining device displaceably carried by said locking assembly for retaining said locking means in said locking position, said locking assembly and said securing piece being aligned with each other in each said first slot so that at one end of the first slot said locking assembly can be positioned in contact with the root of the rotor part in the adjacent said second slot and at the other end of the first slots said securing piece can be positioned in contact with the root of the rotor part in the other adjacent said second slot, said locking assembly and said securing piece each having first end surfaces and second end surfaces extending transversely of the circumferential direction of the rotor, said first end surfaces facing one another and said second end surfaces facing the roots of said rotor parts in said second slots located at the opposite ends of the said first slot, said first end surfaces having corresponding steps arranged to fit together in the locking position, recesses arranged in the roots of said rotor parts to face into said first slots, projections on the second end surfaces of said locking assembly and securing piece arranged to be displaceably fitted into the recesses in said roots, and said first slots having a hammerhead shape in transverse section with inwardly directing ridges extending along the circumferentially extending edges of said first slots at the outer surface of said rotor.

20. An arrangement, as set forth in claim 19, wherein at least one of said locking assembly and securing piece has laterally outwardly extending supporting ridges along the radially outer side surfaces thereof when positioned within said first slots with the supporting ridges arranged to fit against and radially inwardly of the ridges of said first slots, the lengths of said supporting ridges corresponding to the tangential dimension of said second slots measured in the circumferential direction of said rotor, and wherein said locking assembly and said securing piece in each said first slot form a complete closure of the opening into the first slot formed in the circumferentially extending surface of the rotor when in the locking position.

21. An arrangement, as set forth in claim 19, wherein said retaining device comprises a threaded member in threaded engagement with said locking assembly and extending in the radial direction of said rotor, and said locking assembly being displaceable between the locking position and the release position by threadingly displacing said threaded member relative to said locking assembly.

22. An arrangement, as set forth in claim 19, wherein said retaining device includes a spring-biased retaining member for holding said locking assembly in the locking position.

* * * * *